United States Patent [19]

Comeau et al.

[11] Patent Number: 4,902,270

[45] Date of Patent: Feb. 20, 1990

[54] CENTRIFUGE TUBE

[75] Inventors: Paul V. Comeau, Wayne County; Richard A. Leoncavallo, Pittsford, both of N.Y.

[73] Assignee: Nalge Company, Rochester, N.Y.

[21] Appl. No.: 251,855

[22] Filed: Oct. 3, 1988

[51] Int. Cl.[4] ..... B65D 39/00; B04B 5/02; B01L 3/00

[52] U.S. Cl. ..... 494/16; 215/341; 422/102

[58] Field of Search ..... 494/16, 20, 21, 38, 494/85; 220/233, 234, 307, 352, 315, 378; 215/1 C, 344, 343, 355, 358, 359, 364, 31, 247, 292, 280, 383, 354, 341, 211, 212; 604/403, 415; 422/72, 101, 102; D9/439, 440, 441, 443, 447, 454, 384, 390; D24/29

[56] References Cited

U.S. PATENT DOCUMENTS

| | | | |
|---|---|---|---|
| 33,870 | 12/1861 | Wilson | 215/283 |
| D. 81,599 | 7/1930 | Smith . | |
| D. 194,102 | 11/1962 | Cheifetz . | |
| D. 223,449 | 10/1974 | Zauner . | |
| D. 234,779 | 4/1975 | Zauner . | |
| D. 246,467 | 11/1977 | Kurata . | |
| D. 246,600 | 12/1977 | Kurata . | |
| D. 246,800 | 12/1977 | Wong . | |
| D. 252,612 | 8/1979 | Mull . | |
| D. 258,533 | 3/1981 | Pagels . | |
| D. 258,534 | 3/1981 | Nagel . | |
| D. 259,440 | 6/1981 | Martin et al. . | |
| D. 260,731 | 9/1981 | Sarac . | |
| D. 264,247 | 4/1982 | Pagels . | |
| 701,102 | 5/1902 | Stutz . | |
| 746,496 | 12/1903 | Grau | 215/283 |
| 769,960 | 9/1904 | Reed . | |
| 802,760 | 10/1905 | Hovey | 215/364 |
| 905,385 | 12/1908 | Swahn . | |
| 1,064,544 | 6/1913 | Rosenfield et al. | 215/364 |
| 1,120,369 | 12/1914 | Booraem et al. . | |
| 1,138,764 | 5/1915 | Kline . | |
| 1,607,561 | 11/1926 | Pittenger . | |
| 1,674,927 | 6/1928 | Smith . | |
| 2,175,365 | 10/1939 | Saffir . | |
| 2,387,439 | 10/1945 | Grabus, Jr. et al. . | |
| 2,495,942 | 1/1950 | Nosik . | |
| 2,542,702 | 2/1951 | Prow . | |
| 2,559,231 | 7/1951 | Seemar . | |
| 2,634,012 | 4/1953 | Copeman . | |
| 2,695,614 | 11/1954 | Lockhart . | |
| 2,753,868 | 7/1956 | Seemar . | |
| 2,790,994 | 5/1957 | Cardot et al. . | |
| 2,799,981 | 7/1957 | Baker-Carr et al. . | |
| 2,991,902 | 7/1961 | Lind . | |
| 3,071,316 | 1/1963 | Emonte et al. | 422/101 X |
| 3,081,029 | 3/1963 | Gauslaa . | |
| 3,107,805 | 10/1963 | Asher . | |
| 3,221,954 | 12/1965 | Lux . | |
| 3,265,296 | 8/1966 | Mitchell . | |
| 3,266,718 | 8/1966 | Stahl et al. . | |
| 3,279,643 | 10/1966 | Amesbury et al. . | |
| 3,342,365 | 9/1967 | Lux et al. . | |
| 3,375,553 | 4/1968 | Criss . | |
| 3,434,615 | 3/1969 | Barletta . | |
| 3,449,210 | 6/1969 | Rohde . | |
| 3,451,583 | 6/1969 | Lee . | |
| 3,459,369 | 8/1969 | Marks . | |
| 3,464,414 | 9/1969 | Sponnoble . | |
| 3,518,803 | 7/1970 | Wunderlich et al. . | |
| 3,525,365 | 8/1970 | Meulendyk et al. . | |
| 3,525,453 | 8/1970 | Lee . | |
| 3,549,440 | 12/1970 | Adcock et al. . | |
| 3,632,717 | 1/1972 | Showalter et al. . | |
| 3,635,370 | 1/1972 | Romanauskas . | |
| 3,720,502 | 3/1973 | Gropper et al. . | |
| 3,750,645 | 8/1973 | Bennett et al. . | |
| 3,819,111 | 6/1974 | Romanauskas et al. . | |
| 3,820,675 | 6/1974 | Malles . | |
| 3,828,968 | 8/1974 | Kask . | |
| 3,851,029 | 11/1974 | Cornett, III et al. . | |

(List continued on next page.)

*Primary Examiner*—Harvey C. Hornsby
*Assistant Examiner*—Scott J. Haugland
*Attorney, Agent, or Firm*—Marjama & Pincelli

[57] ABSTRACT

A centrifuge tube assembly comprising a centrifuge tube and an inserter for placement within the neck portion of the centrifuge tube. The insert has a rigid portion and pliable portion.

10 Claims, 2 Drawing Sheets

U.S. PATENT DOCUMENTS 3,902,477 9/1975 Gerarde .
3,920,503 11/1975 Keeler .
4,080,175 3/1978 Chulay et al. .
4,107,964 8/1978 Smith .
4,114,803 9/1978 Romanauskas .
4,180,961 1/1980 Collins, III .
4,190,196 2/1980 Larsen .
4,194,640 3/1980 Crankshaw et al. .
4,205,754 6/1980 Nielsen et al. .
4,248,355 2/1981 Kolb et al. .
4,260,438 4/1981 Dembicki et al. .
4,263,251 4/1981 Voegle .
4,272,945 6/1981 Obrist .
4,285,904 8/1981 Ishimaru et al. .
4,290,550 9/1981 Chulay et al. .
4,301,963 11/1981 Nielsen .
4,304,356 12/1981 Chulay et al. .
4,349,399 9/1982 Obrist et al. .
4,358,420 11/1982 Nielsen et al. .
4,390,109 6/1983 Sehülein et al. .
4,396,381 8/1983 Fanger et al. .
4,432,719 2/1984 Hafele .
4,442,129 4/1984 Niwa et al. .
4,472,276 9/1984 Taylor .
4,480,424 11/1984 Seldon .
4,511,349 4/1985 Nielsen et al. .
4,515,752 5/1985 Miramanda .
4,546,894 10/1985 Suinat et al. ..... 215/364 X
4,692,137 9/1987 Anthony ..... 422/72 X

FOREIGN PATENT DOCUMENTS 295413 3/1916 Fed. Rep. of Germany ..... 215/355

CENTRIFUGE TUBE

BACKGROUND OF THE INVENTION

The present invention is directed to centrifuge tubes and, more particularly, to a centrifuge tube assembly capable of being used at high speeds.

Typical prior art centrifuge tubes comprise generally of a cylindrical form having an open end which is capable of receiving a fluid to be centrifuged. Some type of sealing or capping means is provided to maintain the liquid within the tube. The tube is then placed in a rotor and centrifuged as desired. The centrifuge can be done at a variety of angles ranging from 0°-90°. A continuing problem has been leakage of fluid between the sealing means and the tube. This problem becomes even greater when the centrifuge tubes are rotated at high speeds, for example, greater than 10,000 rpm. This problem is particularly acute when the tubes are rotated in the inclined position. Prior art capping or sealing means used in high speed centrifugation has typically been very complicated in their manufacturing, construction as well as in their use and application for attachment to the tube. An example of such complicated procedures are illustrated by U.S. Pat. Nos. 4,301,963 and 4,285,904. In these particular patents, in addition to having a particular tube construction, a heat sealing process is required to permanently seal the tube. This, of course, requires time and the operator to maintain equipment.

Applicants have invented a centrifuge tube assembly which minimizes and/or eliminates the problems of the prior art. The tube assembly of the present invention provides for a simple, quick and efficient means for sealing a centrifuge tube which is particularly useful in high speed and ultra speed centrifugations.

SUMMARY OF THE INVENTION

In one aspect of the present invention, there is provided a centrifuge tube assembly comprising a centrifuge test tube, a pliable insert for placement in the neck portion of the centrifuge tube and a rigid plug for placement within the pliable insert for forcing the pliable insert against the neck portion.

In another aspect of the present invention, a centrifuge tube assembly is provided which comprises a centrifuge tube and a plug for insertion within the neck portion of the tube. The insert has a rigid core and an outer layer made of a pliable material. When the insert is placed within the neck portion, the outer layer is forced against the neck portion.

DESCRIPTION OF THE DRAWINGS

FIG. 8 is a cross-sectional view of a modified plug made in accordance with the present invention.

DETAILED DESCRIPTION OF THE INVENTION

Figure 1:
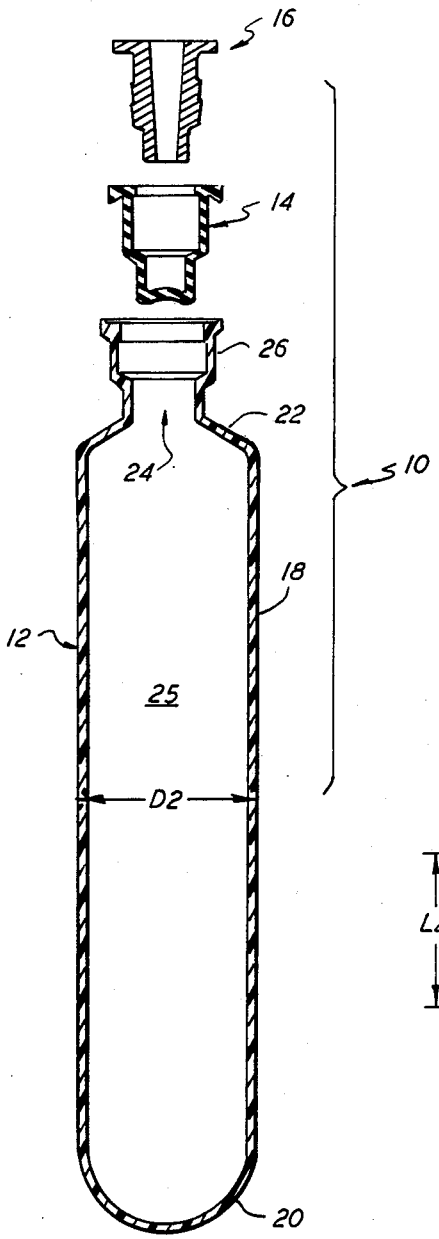
FIG. 1 is an exploded view of a centrifuge tube assembly made according to the present invention.
Figure 2:
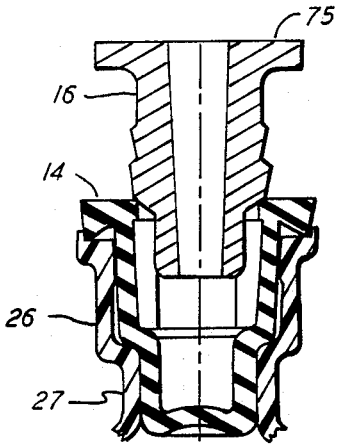
FIG. 2 is an enlarged fragmentary cross-sectional view of the centrifuge assembly of FIG. 1 partially assembled.
Figure 3:
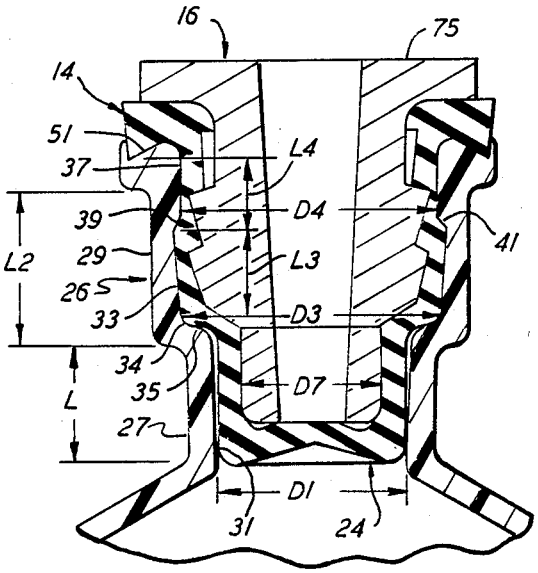
FIG. 3 is an enlarged cross-sectional view similar to FIG. 2 illustrating the centrifuge tube assembly fully assembled.

Referring to FIGS. 1, 2 and 3 there is illustrated a centrifuge tube assembly 10 which comprises a generally elongated cylindrical tube 12, a pliable insert 14 and rigid plug 16. The generally elongated cylindrical tube 12 comprises a generally cylindrical central portion 18 of substantially uniform shape, an enclosed bottom portion 20 intergally formed with the central portion 18 and a top portion 22 also intergally formed with the central portion 18. The central portion 18, bottom portion 20 and top portion form a enclosed receiving chamber 25. The top portion 22 narrows down to a narrow opening 24. A neck portion 26 is intergally formed with the top portion 22 and protrudes from the top portion 22 at the narrow opening 24 and is capable of allowing entry of a liquid in to receiving chamber 25. In the particular embodiment illustrated, the centrifuge 12 tube is made of polypropylene plastic.

Referring to FIG. 3, there is illustrated an enlarged cross-sectional view of the neck portion 26 with pliable insert 14 and rigid plug 16 assembled therein. The neck portion 26 is provided with a first inner longitudinal section 27 having a length L and a cross-sectional inner diameter D1. The neck portion 26 is provided with an outer longitudinal section 29 axially outward and adjacent inner longitudinal section 27 which has a length L2. Longitudinal section 27 has a generally cylindrical inner surface 31. In the particular embodiment illustrated, the inner surface 31 has a slight taper such that diameter D1 increases as you proceed axially outward away from opening 24. Outer longitudinal section 29 is provided with a first outer generally cylindrical surface 33, having a diameter D3 at its axially inner end 34. In the particular embodiment illustrated, D3 is greater than D1 such that a shoulder 35 is formed at the juncture of surfaces 31 and 33. Preferably, the shoulder 35 is disposed at an angle $\alpha$ in the range of 10°-25°. In the particular embodiment illustrated, the shoulder 35 is disposed at approximately 20°. The inner surface 33 is disposed at an angle $\gamma$ from about 0°-10°, preferably in the range of about 3°-7°. In the particular embodiment illustrated the surface 33 is disposed at an angle $\gamma$ of about 5°. In the particular embodiment illustrated, outer longitudinal section 29 is provided with a second outer surface 37 having a substantially cylindrical configuration. Second outer surface 37 has a diameter D4 which is less than diameter D3 of surface 33 immediately adjacent the juncture therebetween such that a under cut 39 is formed therebetween. In the particular embodiment illustrated, the under cut 39 is defined by surface 41. While providing of second inner surface 37 provides additional resistance to movement of the insert, during centrifugation, applicants have found that it is not essential to provide such and the associated undercut 39.

Figure 4:
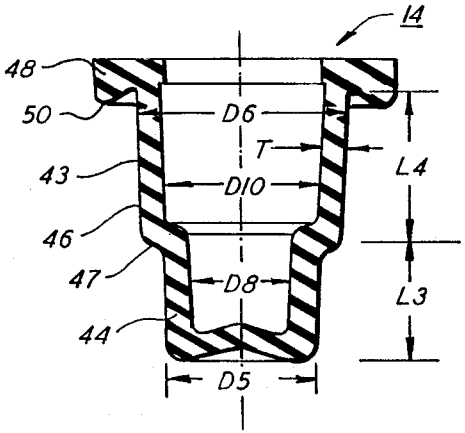
FIG. 4 is a cross-sectional view of the pliable insert of FIG. 1.

Referring to FIG. 4, pliable insert 14 has a generally cup shaped configuration which has an outer surface 43 which conforms generally to the inner configuration of the inner surfaces 31, 33 and 37 of neck portion 26. Pliable insert is made of a material which is compliant but has sufficient stability to enable it to return to its original configuration. The pliable material is of the general consistency of a rubber ball. Applicants have found that the hardness of insert 14 should not be greater than 90 Shore A, as measured using the Standard Shore A Durometer hardness. Applicants have found that Shore A hardness as low as 40 is acceptable. Preferably insert 14 has a Shore A Hardness in the range of about 75 to 87.

In the particular embodiment illustrated, the compliant insert 14 is made of a thermoplastic elastomer for example, Santorene, (manufactured by Monsanto) and Texin (manufactured by Mobay). The pliable insert 14 has a thickness T which is substantially constant throughout its cross-section. In the particular embodiment illustrated, the cross-sectional thickness T is approximately 0.03 inches (0.0753 mm). As can be seen from FIG. 4, the compliant insert 14 has an inner portion 44 having an outer diameter D5 which is equal to or slightly greater than the diameter D1 of neck portion 26. The inner section 44 is designed having length L3 which appropriately equals the length of inner section 31 of neck portion 29. Axially adjacent inner portion 44 is axially adjacent outer portion 46 and has a length L4 and outer diameter D6 which is preferably slightly greater than the inner diameter D3. A shoulder 47 is formed at the junction between inner section 44 and outer section 46 and is designed to mate with shoulder 35 of neck portion 26. At its outer end, pliable insert 14 is provided with a annular flange 48 which mates with the outer surface of neck portion 26 and prevents further entry of the pliable insert within the neck portion. In the particular embodiment illustrated, the flange 48 is provided with an inner projecting portion 50 which mates in a recess 51 on the top neck portion 26. However, projectional portion 50 and recess 51 may be omitted if so desired.

Figure 5:
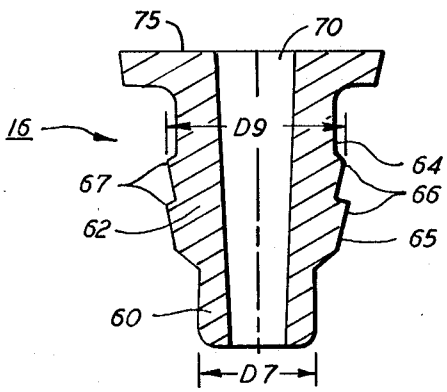
FIG. 5 is a cross-sectional view of the rigid plug of FIG. 1.

Referring to FIG. 5, there is illustrated, rigid plug 16 for placement within the pliable insert 14. In the particular embodiment illustrated, rigid plug 16 is made of a plastic material.

The plug 16 has an outer surface configuration designed to provide a clamping force between the insert 14 and neck portion so as to provide a secure sealing relationship therebetween. The plug 16 is provided with an inner cylindrical section 60 designed to fit within the inner portion 44 of pliable insert 14. The inner section 60 has a diameter D7 which is substantially equal to or slightly greater than the inner diameter D8 of pliable insert 14 in that area. The inner section 60 helps to maintain axial alignment of the plug 16 within the neck portion 26. Axially adjacent inner section 60 is an outer generally cylindrical section 62 having an annular outer surface 64. Annular outer surface 64 is provided with at least one substantially radially extending annularly continuous projection 66 which clampingly secures said pliable insert 14 between the rigid plug 16 and neck portion 26. In the particular embodiment illustrated, two projections 66 are provided. The projections 66 each have an annular surface 65 which increases as it proceed axially outward toward its outer end 67. The projections 66 each have an outer diameter D9 greater than the inside diameter D10 of said pliable insert 14, but less than the diameter of the axially adjacent neck portion. The difference being such that it pinches or causes said pliable insert to deform therebetween and form a sealing relationship. Projection has a diameter D9 such that pliable insert 14 is compressed in the range of about 50 to 80% of its initial thickness T, preferably in the range of about 60 to 70% The outer end 67 of the axially inner projections 66 is disposed below under cut 39. In the preferred embodiment illustrated, two projections 66 are provided, one axially above the other and having the same general configuration, however, applicants have found that only one projection 66 provides satisfactory performance.

In the particular embodiment illustrated, rigid plug 16 is provided with a substantially centrally located bore 70 therethrough which allows the placement of a needle therethrough to allow access to the chamber 27 by passing the needle through pliable insert 14.

In the preferred embodiment, the pliable insert 14 is illustrated as a separate element, however, the present invention is not so limited. If desired, rigid plug 16 may be provided with a layer 80, permanently secured thereto, of a material having substantially the same properties as the pliable insert 14 as illustrated in FIG. 8.

Figure 7:
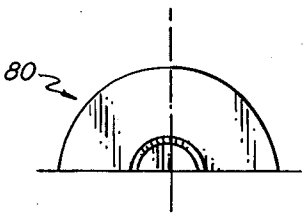
FIG. 7 is a half top view of FIG. 6.
Figure 6:
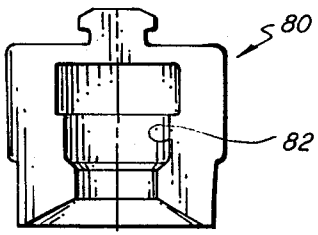
FIG. 6 is an elevational view of a spacer assembly for use with the centrifuge tube assembly in a rotor.

In order to clearly understand the present invention, a brief description on its use will now be discussed. First, a centrifuge tube 12 as previously discussed is provided. The appropriate liquid to be centrifuged is placed therein. Thereafter a pliable insert 14 is placed in neck portion 26 therein. Then rigid plug 16 is forced axially inwardly to the position illustrated in FIG. 2. This causes the projection to deform the pliable insert 14 and pinch pliable insert 14 between the rigid plug 16 and relatively rigid neck portion 26. This can easily accomplished by simply pressing the top 75 of plug 16 by the hands of the user. No special tools or equipment is required or necessary. Thereafter, the centrifuge tube assembly is placed in a rotor. A pair of half spacers 80, as illustrated in FIGS. 6 and 7 are placed around the neck portion 26 of tube 12. Spacers 80 are made of rigid material, preferably metal. In the particular embodiment illustrated spacers 80 are made of aluminum. The inside surface 82 of the spacer is designed to mate with the outer surface of neck portion 26. Applicants have found that the subject assembly can be used to speeds up to about 80,000 rpm without any substantially loss of liquid.

The unique centrifuge assembly of the present invention provides a very tight and secure seal which allows for easy access after the tube has been centrifuged.

It is to be understood by those skilled in the art that various other modifications may be made without departing from the scope of the present invention. That scope of the present invention being limited by the following claims.

What is claimed is:

1. A centrifuge tube assembly for holding a fluid sample, said centrifuge tube assembly comprising:

a centrifuge tube having an elongated cylindrical central portion of uniform shape, an enclosed bottom portion integrally formed with said central portion, an enclosed top portion integrally formed with said central portion which narrows down to a narrow opening, and a neck portion integrally formed on and protruding from said top portion at said narrow opening which is capable of receiving a liquid to fill a chamber formed by said central portion, said bottom portion and said top portion, said neck portion having an inner longitudinal section having an inner cylindrical surface, said inner cylindrical surface having an inside diameter of a first predetermined value, said neck portion having an outer longitudinal generally cylindrical section adjacent said inner longitudinal section having a first outer cylindrical surface, said inner longitudinal section and said outer longitudinal generally cylindrical section forming a shoulder at their junction which extends radially outwardly from said inside diameter of said inner longitudinal section, said shoulder being disposed at an angle in the range of 10° to 25°, said first outer cylindrical surface being disposed at an angle so that the cross sectional diameter increases toward the outer end of said outer longitudinal generally cylindrical section;

an insert made of a pliable material, said insert having an inner cylindrical section, a closed bottom section integrally formed with said inner cylindrical section and a second outer cylindrical section integrally formed at the outer end of said inner cylindrical section, said inner cylindrical section, outer section cylindrical section and closed bottom section having substantially the same thickness, said inner cylindrical section having an outer diameter substantially equal to said inside diameter of said inner longitudinal section, said second outer cylindrical section having an outer diameter greater than said outer diameter of said inner cylindrical section of said insert and forming a shoulder at the junction thereof, said inner cylindrical section of said insert forms an inner bore of a first diameter and said outer cylindrical section forms a second bore of a second diameter, said second diameter being greater than said first diameter;

a rigid plug for placement within said insert and forcing said insert against the inside surface of said neck portion so as to form a secure sealing relationship therewith, said plug having a first generally cylindrical inner end of a first diameter which extends within said inner bore of said insert and said inner longitudinal section of said neck portion, a first conical section integrally formed with the outer end of said first generally cylindrical inner end disposed at a first angle substantially parallel to the angle at which said shoulder of said neck portion is disposed such that when said plug is placed within said insert and neck portion said first conical section is disposed opposite said shoulder portion of said neck portion, a second conical section integrally formed with said first conical section which increases in diameter as it proceeds axially outwardly toward its outer end, said outer end of the second conical section having a diameter of a predetermined size greater than said inside diameter of said insert in said second outer cylindrical section but less than the diameter of said first outer cylindrical surface of said outer longitudinal generally cylindrical section of said neck portion so as to pinch said pliable insert between said plug and neck portion, adjacent said second conical section and integrally formed with said plug is an outer shank portion having a diameter substantially less than the diameter of said second conical section at its outer end, said shank and said outer end of said second conical section forms a recess at their junction.

2. A centrifuge tube assembly according to claim 1 wherein said plug has a substantially central axially extending bore therethrough for allowing access to said bottom surface of said insert.

3. A centrifuge tube assembly according to claim 1 further comprising a pair of spacers designed for placement around said neck portion, said spacers having an inside configuration matching the outer configuration of said neck portion.

4. A centrifuge assembly according to claim 1 wherein said outer longitudinal generally cylindrical section has a second outer cylindrical surface adjacent said first outer cylindrical surface, said second outer cylindrical surface having a diameter less than that of said first outer cylindrical surface at the juncture between said first and second outer cylindrical surfaces.

5. A centrifuge tube assembly for holding a fluid sample, said centrifuge tube assembly comprising:

a centrifuge tube having an elongated cylindrical central portion of uniform shape, an enclosed bottom portion integrally formed with said central portion, an enclosed top portion integrally formed with said central portion which narrows down to a narrow opening, and a neck portion integrally formed on and protruding from said top portion at said narrow opening which is capable of receiving a liquid to fill a chamber formed by said central portion, said bottom portion and said top portion, said neck portion having an inner longitudinal section having an inner cylindrical surface, said inner cylindrical surface having an inside diameter of a first predetermined value, said neck portion having an outer longitudinal generally cylindrical section adjacent said inner longitudinal section having a first outer cylindrical surface, said inner longitudinal section and said outer longitudinal generally cylindrical section forming a shoulder at their junction which extends radially outwardly from said inside diameter of said inner cylindrical surface, said shoulder being disposed at an angle in the range of 10° to 25°, said first outer cylindrical surface being disposed at an angle so that the diameter increases toward the outer end of said outer longitudinal generally cylindrical section, said neck portion having an axial outer section adjacent the outer end of the outer longitudinal generally cylindrical section having a diameter smaller than said diameter of said outer end of said first outer cylindrical surface so as to form an undercut section at their junction;

a rigid plug for placement within said neck portion so as to form a secure sealing relationship therewith, said rigid plug having an rigid outer engaging surface said plug having a first generally cylindrical inner end of a first diameter which extends within said inner longitudinal section of said neck portion, a first conical section integrally formed with the outer end of said first generally cylindrical inner end disposed at a first angle substantially parallel to the angle at which said shoulder of said neck portion is disposed such that when said plug is placed within said neck portion said first conical section is disposed opposite said shoulder portion of said neck portion, a second conical section integrally formed with said first conical section which increases in diameter as it proceeds axially outwardly toward its outer end, said outer end of the second conical section having a diameter of a predetermined size, adjacent said second conical section and integrally formed with said plug is an outer shank portion having a diameter substantially less than the diameter of said second conical section at its outer end, said shank and said outer end of said second conical section forms a recess at their junction, said plug having a layer of a compliant material about said rigid outer engaging surface, said layer being made of a material and having a thickness such that a sealing relationship is formed between said plug and said neck portion.

6. A centrifuge tube assembly according to claim 5 wherein said plug has a substantially central axially extending bore therethrough for allowing access to said bottom surface of said insert.

7. A centrifuge tube assembly according to claim 5 further comprising a pair of spacers designed for placement around said neck portion, said spacers having an inside configuration matching the outer configuration of said neck portion.

8. A centrifuge tube assembly according to claim 5 wherein said axially outer section has a second outer cylindrical surface adjacent said first outer cylindrical surface, said second outer surface having a diameter less than that of said first outer surface at the juncture between said first and second outer surfaces.

9. A centrifuge tube assembly according to claim 1 wherein said rigid plug is made of a plastic material.

10. A centrifuge tube assembly according to claim 5 wherein said rigid plug is made of a plastic material.

* * * * *